US009183767B2

(12) United States Patent
Grush

(10) Patent No.: US 9,183,767 B2
(45) Date of Patent: Nov. 10, 2015

(54) HIGH-PERFORMANCE SIGNAGE SYSTEM

(71) Applicant: Mark V. Grush, Littleton, CO (US)

(72) Inventor: Mark V. Grush, Littleton, CO (US)

( * ) Notice: Subject to any disclaimer, the term of this patent is extended or adjusted under 35 U.S.C. 154(b) by 5 days.

(21) Appl. No.: 14/449,846

(22) Filed: Aug. 1, 2014

(65) Prior Publication Data

US 2015/0033605 A1 Feb. 5, 2015

Related U.S. Application Data

(60) Provisional application No. 61/861,275, filed on Aug. 1, 2013.

(51) Int. Cl.

| | |
|---|---|
| ***G09F 7/00*** | (2006.01) |
| ***G09F 15/00*** | (2006.01) |
| ***G09F 13/02*** | (2006.01) |
| *G09F 27/00* | (2006.01) |
| *G09F 7/18* | (2006.01) |

(52) U.S. Cl.

CPC ..... *G09F 15/0037* (2013.01); *G09F 13/02* (2013.01); *G09F 27/007* (2013.01); *G09F 2007/1804* (2013.01)

(58) Field of Classification Search

CPC .... E04H 12/2215; A45F 3/44; G09F 15/0025

USPC ..... 40/611.13, 607.05, 607.06, 611.01, 40/611.05, 645, 607.01, 661.11, 668

See application file for complete search history.

(56) References Cited

U.S. PATENT DOCUMENTS

| | | | | | |
|---|---|---|---|---|---|
| 1,526,381 | A | * | 2/1925 | Slawson | 40/124.5 |
| 1,902,875 | A | | 3/1933 | Mason | |
| 2,022,160 | A | | 11/1935 | Sorensen et al. | |
| 2,052,030 | A | * | 8/1936 | Holzer | 40/645 |
| 2,552,745 | A | * | 5/1951 | Stanley, Sr. et al. | 40/607.12 |
| D186,779 | S | * | 12/1959 | Borin | D20/41 |
| 3,058,246 | A | * | 10/1962 | Schoeffier | 40/606.13 |
| 3,143,817 | A | | 8/1964 | Paulson | |
| 3,267,823 | A | | 8/1966 | MacRae | |
| 3,785,331 | A | * | 1/1974 | Ferris | 116/63 R |
| D237,994 | S | * | 12/1975 | Davis et al. | D20/43 |
| D246,513 | S | | 11/1977 | Garneau | |
| 4,185,424 | A | | 1/1980 | Streit | |
| 4,233,769 | A | * | 11/1980 | Archer | 40/607.12 |
| 4,793,083 | A | | 12/1988 | McDonald | |
| 4,831,760 | A | | 5/1989 | Walker | |
| 5,181,335 | A | | 1/1993 | Todd | |
| D353,405 | S | * | 12/1994 | Cutler | D20/41 |
| 5,903,991 | A | | 5/1999 | Sasse | |
| 6,349,514 | B1 | | 2/2002 | Adams | |
| 6,553,701 | B1 | * | 4/2003 | Neisen et al. | 40/645 |
| 7,866,075 | B2 | | 1/2011 | Meeker et al. | |
| D679,457 | S | | 4/2013 | Chance et al. | |

* cited by examiner

*Primary Examiner* — Casandra Davis

(74) *Attorney, Agent, or Firm* — Sheridan Law, LLC

(57) ABSTRACT

The disclosure provides apparatus and methods of use pertaining to the display of yard or lawn signage. One embodiment provides a two-part system for displaying signage. The system includes a flexible sign panel having installation tabs and a rigid, injection-molded stake having holding portions configured to receive and retain the installation tabs of the sign panel. The rigid stake also includes retention barbs to facilitate ground stability and a strike pad designed to absorb and distribute impact forces applied during stake installation. Other embodiments are also disclosed.

18 Claims, 12 Drawing Sheets

HIGH-PERFORMANCE SIGNAGE SYSTEM

REFERENCE TO PENDING PRIOR PATENT APPLICATION

This application claims the benefit under 35 U.S.C. 119 (e) of U.S. Provisional Patent Application No. 61/861,275, filed Aug. 1, 2013 by Mark V. Grush for "HIGH PERFORMANCE SIGN CONSTRUCTION" which patent application is hereby incorporated herein by reference.

BACKGROUND

Lawn or yard signs such as, for example, political signs, real estate signs, apartment signs, construction signs, and/or security signs, are used for a variety of purposes. They inform visitors, warn passersby, draw potential customers to properties, and more.

Generally, lawn signs are formed of a laminated paper or cardboard sign attached to a metal stake. FIGS. 1-2 show front plan and back perspective views of a traditional lawn-sign system 20 that is common in the prior art, respectively. Lawn-sign system 20 includes a u-shaped aluminum stake 22, a laminated paperboard sign 24, and a rubber cap 26.

Traditional lawns sign systems such as prior art system 20 are simple in design and functionality and, as a result, exhibit several deficiencies. Initially, aluminum stakes such as stake 22 are slightly malleable and are vulnerable to the strike forces required to pound the sign systems into the ground. While traditional sign systems often include some sort of shock absorber such as rubber cap 26, these thin barriers are not sufficient to prevent the damage often caused by pounding the stake into dry, hard, and/or rocky soil. Once driven into the ground, traditional stakes are also susceptible to forces applied by wind and other inclement weather. In both situations, traditional stakes like stake 22 have a tendency to bend. Even if the metal may be straightened, this solution leaves the stake with unsightly, visible deformities.

While traditional stakes may be damaged upon ground installation, as discussed above, the smooth, streamlined surface of traditional stakes also allows them to be too easily removed. This ease of removal renders traditional signs susceptible to vandals, accidents, and inclement weather.

Traditional metal stakes are also limited aesthetically in that they offer a single color—silver. While the user may customize the sign to be attached to the stake, he or she cannot customize the appearance of the stake itself, which detracts from the overall effectiveness of the sign. Any modifications or added features a user wishes to include on a traditional stake (e.g., installation instructions, warnings, accessory mounts, etc.) must be added to the stake as an afterthought requiring additional parts, hardware, and oftentimes, tools. For instance, instructions or warnings must be applied as an external sticker. Accessories (e.g., that provide lighting, sound, etc.) must be attached using clamps, screws, adhesives, or other attachment mechanisms.

Traditional signs like prior art system 20 also commonly require hardware such as nuts, bolts, rivets, and/or double-sided tape to simply attach the sign to the stake. In FIG. 1, sign 24 is adhered to stake 22 via a nine-inch strip of double-sided tape (not shown). This need for additional attachment hardware is not only inconvenient, it often requires a sign to be attached to or installed upon the stake prior to inserting the stake into the ground. As a result, traditional signs can be damaged when a user misaims the hammer during ground installation.

This method of sign attachment also leaves the sign's placement in relation to the stake a function of the user's judgment. He or she eyeballs the sign and stake in an attempt to screw, rivet, and/or adhere the sign to the stake in a straight, centered position. Oftentimes this manual placement results in a skewed appearance. Once a particular traditional sign has run its course, it cannot be easily replaced without specialty tools. In certain cases such as those involving double-sided tape, removal can damage or even destroy the sign.

A few existing lawn stakes and sign/stake combinations or systems attempt to address one or more of the shortcomings discussed above. While these existing products tackle select deficiencies, such as ease of stake removal, predisposition to bend, or shock absorption, no existing product addresses the collection of issues present in traditional lawn-sign systems. Thus, lawn-sign products existing in the prior art fail to provide a simple, reliable, affordable, and aesthetically pleasing lawn-sign solution.

SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

On embodiment provides a two-part system for displaying signage. The system includes flexible signage having first and second installation tabs and a rigid stake having top and bottom ends, front and back sides, and a solid core centered within an axially radiating cross-section. The rigid stake includes first and second holding portions protruding from the front side between the top and bottom ends. These holding portions are configured to receive and retain the first and second installation tabs of the signage, respectively. The rigid stake also includes a plurality of barbs protruding axially from the bottom end and a strike pad protruding vertically from the top end. The strike pad may have honeycomb structure configured to absorb installation force and distribute the force through the solid core and the axially radiating cross-section of the stake.

Another embodiment provides a method for displaying signage using a signage system having (a) a sign panel with at least two installation tabs and (b) a rigid stake with a top strike pad, a tapered bottom end, and at least two holding portions configured to receive and retain the sign panel. The method includes the steps of inserting the tapered bottom end of the rigid stake into a layer of ground, placing a first of the installation tabs of the sign panel into a first of the holding portions of the rigid stake, flexing the sign panel outward such that a second of the installation tabs of the sign panel aligns with a second of the holding portions of the rigid stake, and snapping the second installation tab into the second holding portion of the stake to install the sign panel upon the stake.

Yet another embodiment provides a signage system having a flexible plastic sign with top and bottom installation tabs located at a center of the sign, where the sign is configured to move between flat and bowed positions, and a rigid stake molded from acetal plastic. The stake has a top end, a tapered bottom end, and a solid core centered within an axially radiating cross-section and includes (a) top and bottom holding portions disposed between the top end and the tapered bottom end, where the top and bottom holding portions are configured to receive and retain the top and bottom installation tabs of the sign, respectively, (b) a disc support integrated into the stake between the top and bottom holding portions, where the disc support is configured to provide a permanent mounting mechanism for the sign, (c) a plurality of retention barbs protruding radially from the tapered bottom end, (d) a strike pad protruding vertically from the top end, where the strike pad has a honeycomb structure configured to absorb installation force and distribute the force through the solid core and the axially radiating cross-section, and where the strike pad includes an integrated accessory mount having a counterbore encircling a coaxial D-shaped well, and (e) a solar-powered light assembly having a base configured to interlock with the accessory mount.

Other embodiments are also disclosed.

Additional objects, advantages, and novel features of the technology will be set forth in part in the description which follows, and in part will become more apparent to those skilled in the art upon examination of the following, or may be learned from practice of the technology.

BRIEF DESCRIPTION OF THE DRAWINGS

Non-limiting and non-exhaustive embodiments of the present invention, including the preferred embodiment, are described with reference to the following figures, wherein like reference numerals refer to like parts throughout the various views unless otherwise specified. Illustrative embodiments of the invention are illustrated in the drawings, in which.

DETAILED DESCRIPTION

Embodiments are described more fully below in sufficient detail to enable those skilled in the art to practice the system and method. However, embodiments may be implemented in many different forms and should not be construed as being limited to the embodiments set forth herein. The following detailed description is, therefore, not to be taken in a limiting sense.

Various embodiments of the systems and methods described herein relate to the display of ground signage systems commonly referred to as lawn or yard signs.

Figure 3:
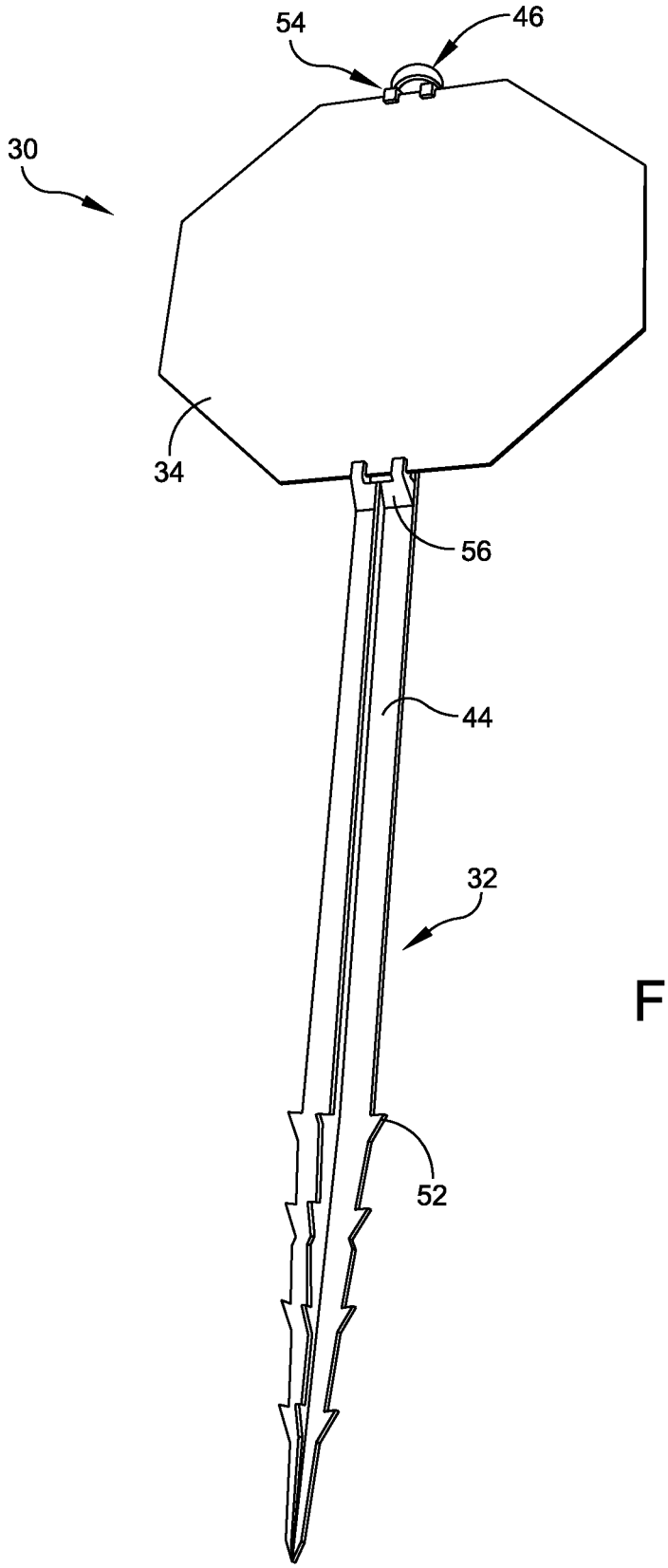
FIG. 3 provides a front perspective view of one embodiment of a signage system.

FIG. 3 provides a front perspective view of one embodiment of a two-part signage system 30. In its most basic form, signage system 30 includes a stake 32 and one or more sign panels 34, discussed below.

Sign panel 34 is formed of advanced materials that resist UV effects that cause signage to yellow and/or fade over time. Notably, one embodiment of sign panel 34 may be formed of polystyrene with color silkscreen printing that is water resistant, wear resistant, and that features UV resistant ink. Polystyrene material can withstand extreme temperature swings between −40 and 194 degrees Fahrenheit and is bend and crack resistant. While the polystyrene of sign panel 34 is resistant to permanent deformation and cracking, it is designed to flex in a manner that allows sign panel 34 to be bowed into convex and/or concave shapes. This ability facilitates the installation of sign panel 34 onto stake 32, as discussed below in reference to FIGS. 4, 7, and 8.

Figure 1:
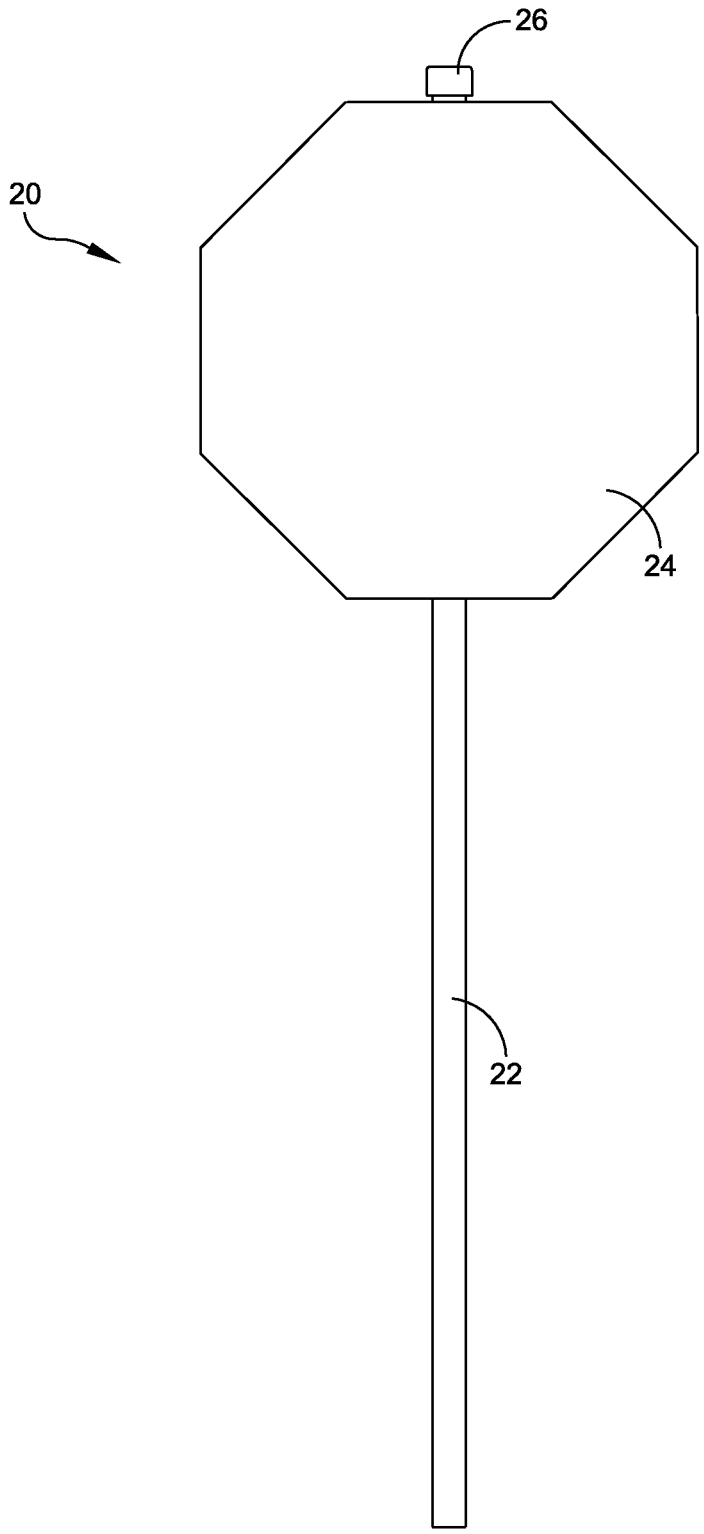
FIG. 1 (PRIOR ART)
FIG. 1 provides a front plan view of a traditional lawn-sign system common in the prior art.
Figure 2:
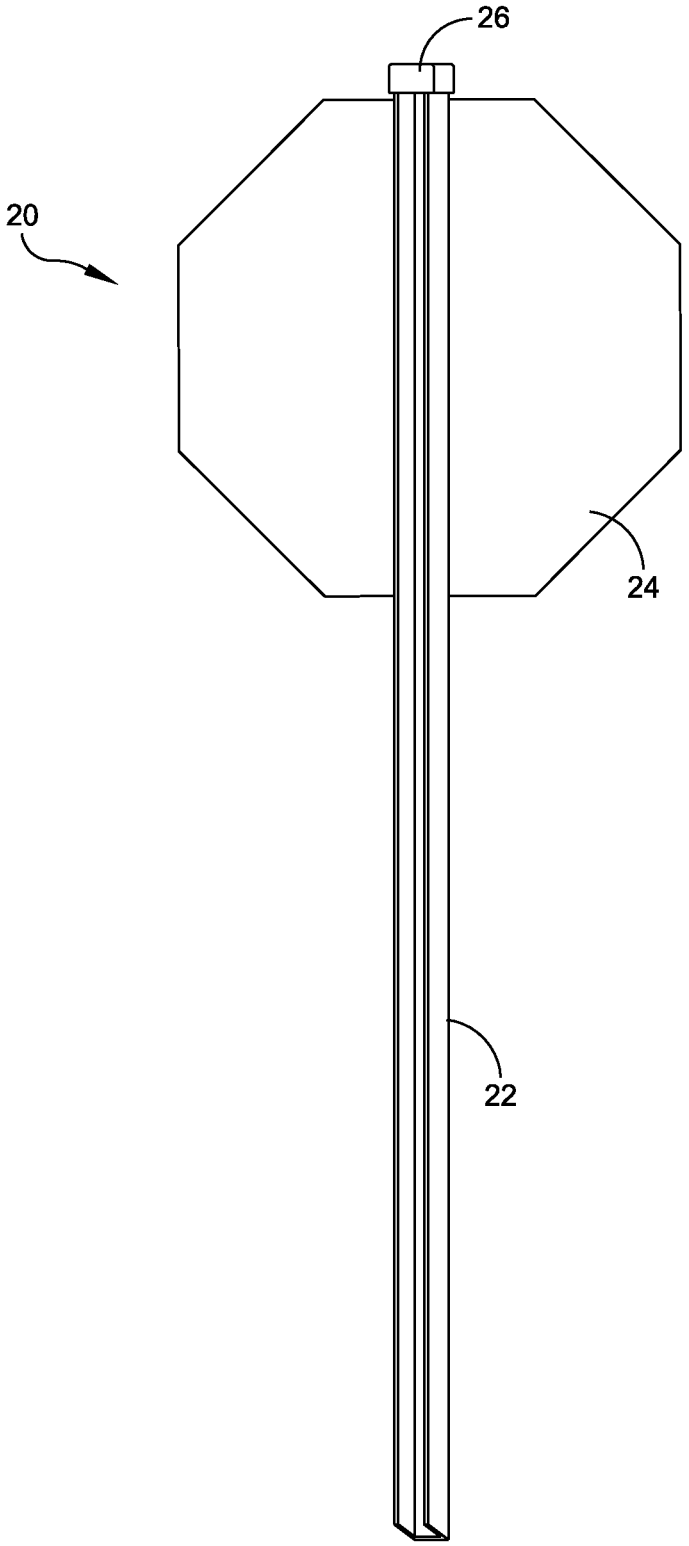
FIG. 2 (PRIOR ART)
FIG. 2 provides a back perspective view of the lawn-sign system of FIG. 1.

Stake 32 provides a robust and attractive vehicle for supporting a variety of shapes, sizes, and types of sign panels 34. Rather than a length of bendable, u-shaped aluminum, as discussed above in reference to prior art stake 22 shown in FIGS. 1-2, stake 32 may be injection molded from high-performance acetal plastic, resulting in a rigid structure with multi-dimensional stability. Rather than bending or deforming in reaction to environmental and/or installation forces, stake 32 merely flexes before returning to its original shape. In some embodiments, the plastic may be impregnated with glass to further increase stiffness and stability. The plastic may also be ultra-violet (UV) modified so that stake 32 resists damaging sun rays over years of service.

Molding stake 32 from high-performance plastic provides several advantages over the prior art. For example, while one embodiment of stake 32 may be black in color in order to further increase UV resistance, stake 32 may be molded out of plastic having any appropriate or desirable color. This customization ability allows a user to specify a stake color that conforms to particular marketing and/or promotional schemes and that is generally more aesthetically pleasing. In addition, the injection mold design may be configured to imprint instructions, warnings, and/or other important user messages directly into the plastic, negating the need for later etchings, markings, or external stickers.

Figure 4:
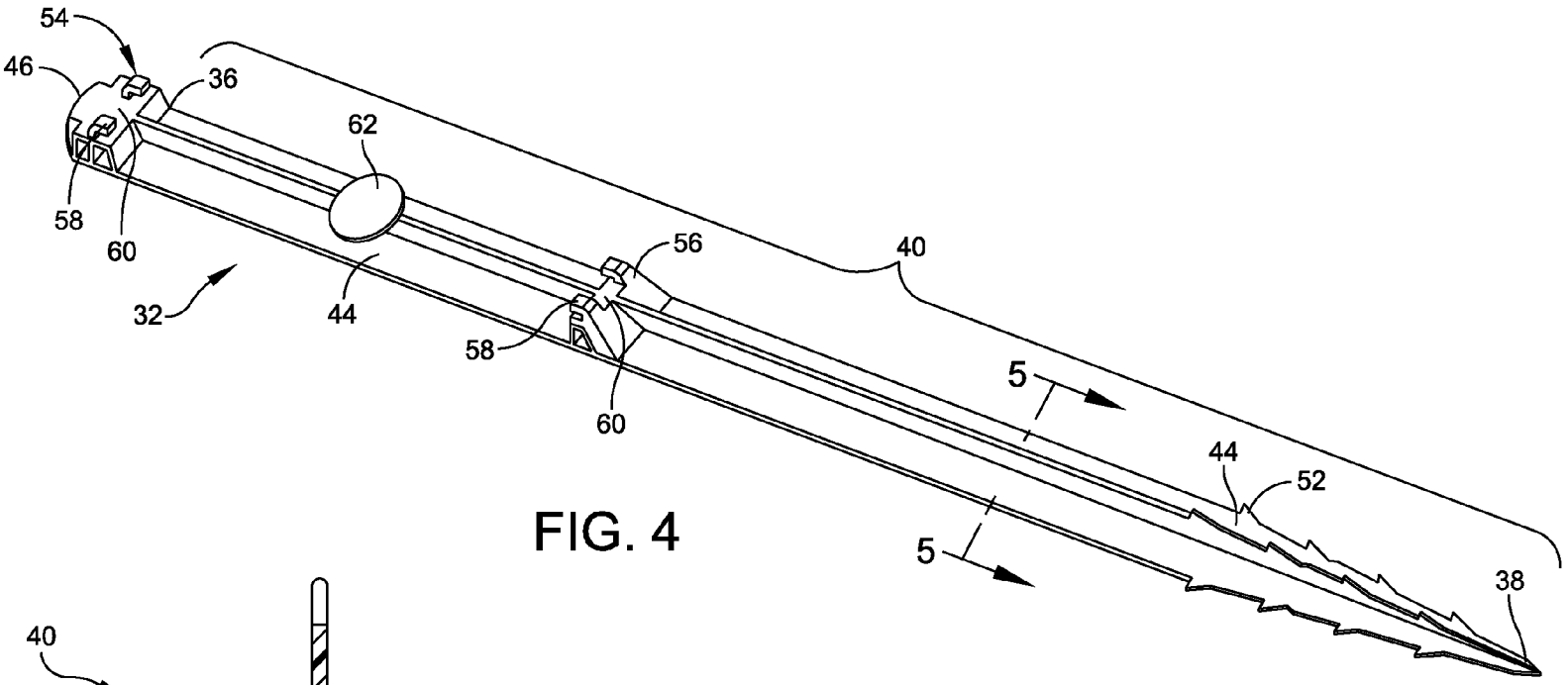
FIG. 4 provides a side perspective view of one embodiment of a stake for the signage system of FIG. 3.
Figure 5:
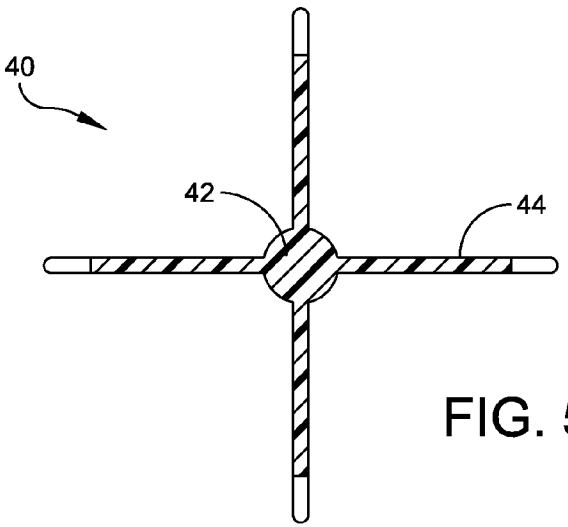
FIG. 5 provides a section view of the stake of FIG. 4.

Beyond encouraging customization and resilient material properties, the injection molding of stake 32 allows for the incorporation of multiple features that improve the overall functionality of stake 32. FIG. 4 provides a perspective view of stake 32, which shows many of these advantageous features. Specifically, one embodiment of stake 32 may have a top end 36, a tapered bottom end 38, and a body 40 extending approximately thirty inches there between. Body 40 may have a unique cross-section, detailed in FIG. 5, that is formed of a solid core 42 centered within a set of four axially radiating fins 44 that form an x-shaped cross-section. In this configuration, solid core 42 creates a backbone of structural support, while fins 44 add additional rigidity to resist twisting in response to external forces asserted by wind, rain, snow, and other environmental factors.

As shown in FIG. 4, tapered bottom end 38 of stake 32 may include a number of retention barbs 52 that are interspersed along fins 44. Retention barbs 52 grip the soil within which stake 32 is installed to discourage uprooting by environmental forces such as wind, rain, snow, and other inclement weather patterns. Retention barbs 52 also make it more difficult to pull stake 32 free of the ground, thereby discouraging vandals and other miscreants from impulsively uprooting signage system 30 (FIG. 3).

Figure 6:
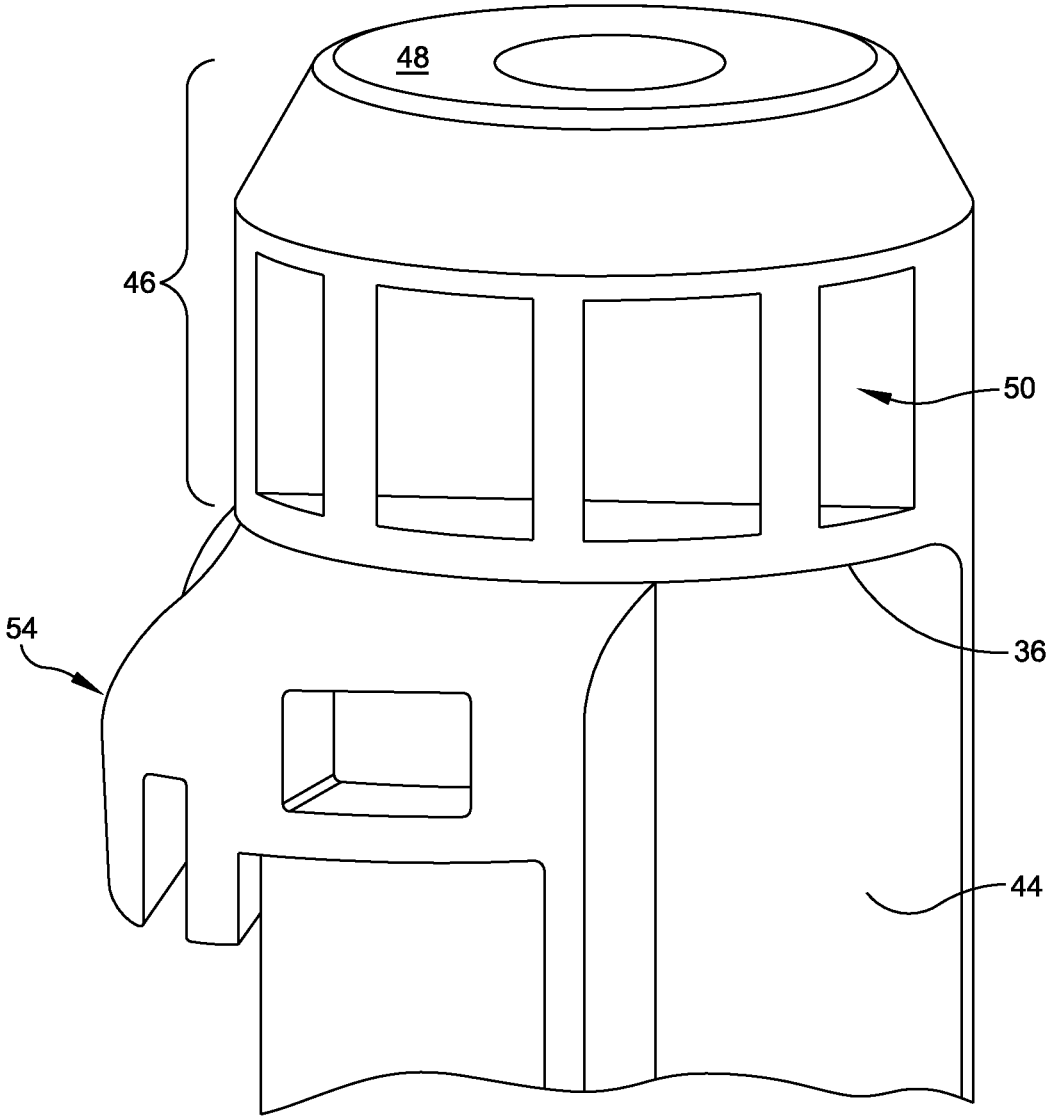
FIG. 6 provides a side perspective view of a strike pad of the stake of FIG. 4.

A strike pad 46 may protrude vertically from top end 36 of stake 32. As detailed in enlarged FIG. 6, strike pad 46 may include a strike surface 48 designed to receive installation forces generated upon the impact of a hammer, mallet, or other driving tool used to drive stake 32 into the ground. Strike pad 46 includes a honeycomb structure 50 that encircles solid core 42 (FIG. 5) of stake 32. Honeycomb structure 50 absorbs the installation forces received at strike surface 48 and distributes them throughout the length of solid core 42 (FIG. 5) and radiating fins 44 of stake 32. Relying on the combination of honeycomb structure 50, solid core 42, and axially radiating fins 44, stake 32 can easily withstand the oftentimes significant impact forces that are necessary to drive stake 32 into hard or rocky soil.

Figure 8:
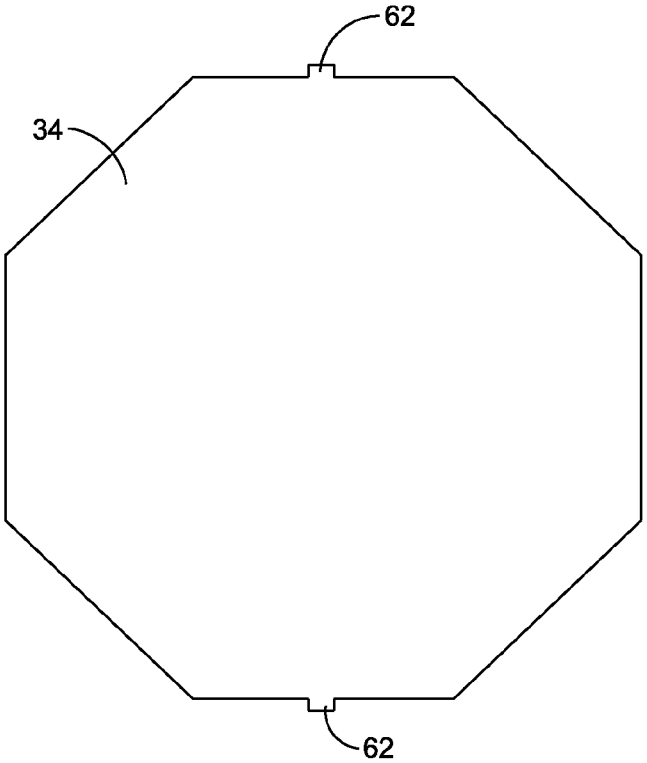
FIG. 8 provides a front plan view of a sign panel for the signage system of FIG. 3.

Returning to FIG. 4, one embodiment of stake 32 includes integrated top and bottom holding portions, or sign gutters, 54, 56 that are specially designed to receive and retain sign panels 34 without requiring the use of external hardware such as nuts, bolts, rivets, or the like. Each holding portion 54, 56 includes two brackets 58 separated by a centering gap 60. Centering gaps 60 are designed to align with installation tabs 62 that protrude from the top and bottom of sign panel 34, as shown in FIG. 8. Notably, a horizontal span of holding portions 54, 56 may be customized to accommodate varying sign widths, while the locations of holding portions 54, 56 along a centerline of stake 32 may be customized to accommodate signs of varying height.

To install sign panel 34 onto stake 32, a user may simply align one of installation tabs 62 with a corresponding centering gap 60 and then bow or flex sign panel 34 outward to facilitate the alignment of the opposing installation tab 62 with the opposing centering gap 60. Once both tabs 62 are aligned with both centering gaps 60, the user may snap sign panel 34 into the installed position shown in FIG. 3.

Beyond obviating the need for external hardware and/or tools, the flex-and-snap fit described above provides a secure mount that prevents sign movement after installation. In addition, the use of centering gaps 60 and centering tabs 62 ensures that sign panel 34 fits stake 32 in a manner that is reproducibly straight, centered, and even. Because sign panel 34 may be quickly and easily installed after stake 32 is pounded into the ground, there is no risk of sign damage as a result of misaligned hammer strikes that may occur when pounding stake 32 into the ground. Further, when the user is finished with sign panel 34 and/or wishes to replace sign panel 34 with an updated version or an entirely new panel, he or she can make the transition within seconds.

Figure 7:
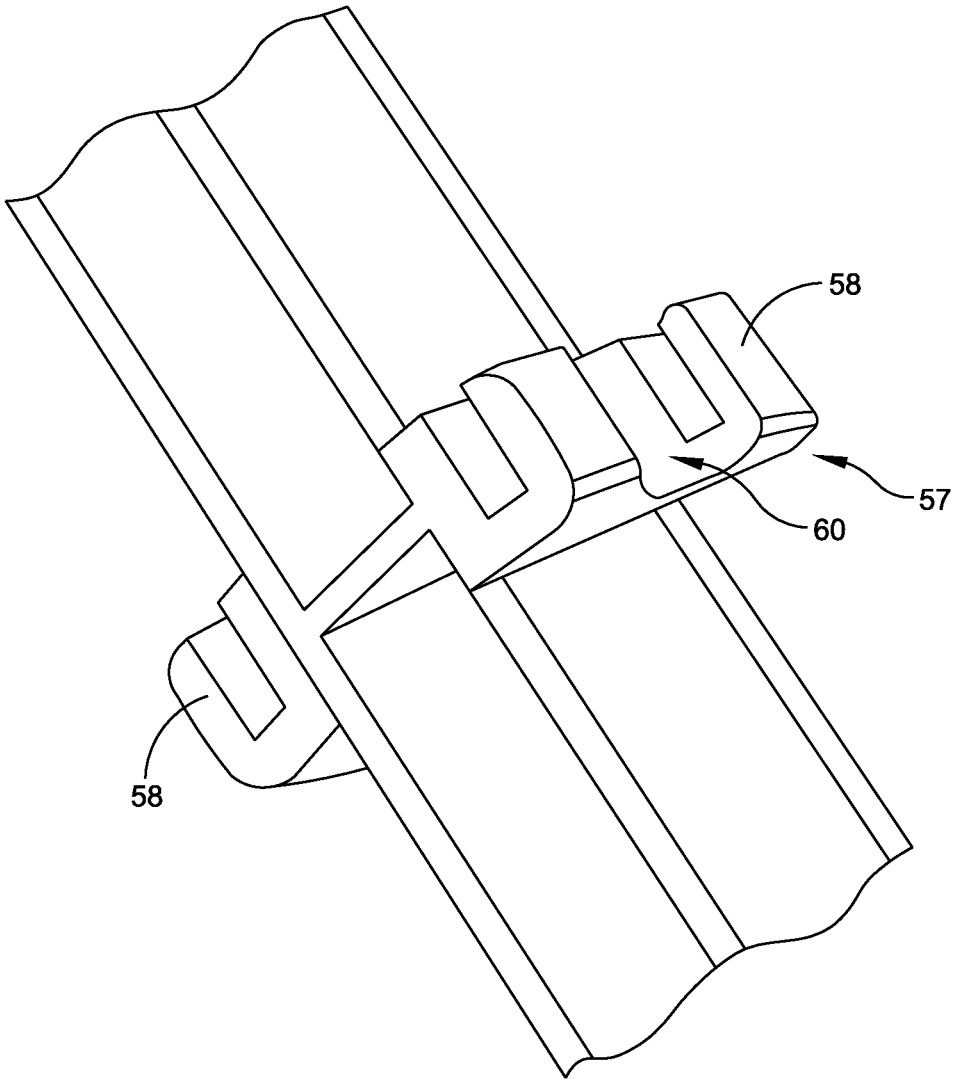
FIG. 7 provides a side perspective view of a signage holding portion of the stake of FIG. 4.

While FIG. 4 depicts holding portions 54, 56 protruding from a single face or side of stake 32, it should be understood that an alternative embodiment of a holding portion, holding portion 57 shown in FIG. 7, may include brackets 58 separated by centering gap 60 on dual faces or sides of stake 32. In this embodiment, a user may install opposing signs that face outward in dual directions using the flex-and-snap fit described above.

If the user prefers additional retaining force for sign 34, one embodiment of stake 32 may also include a center disc support 62, as shown in FIG. 4. Center disc support 62 may be coated with adhesive or serve as a base for double-sided tape that may contact sign panel 34 and provide additional retaining force for sign 34.

Figure 9:
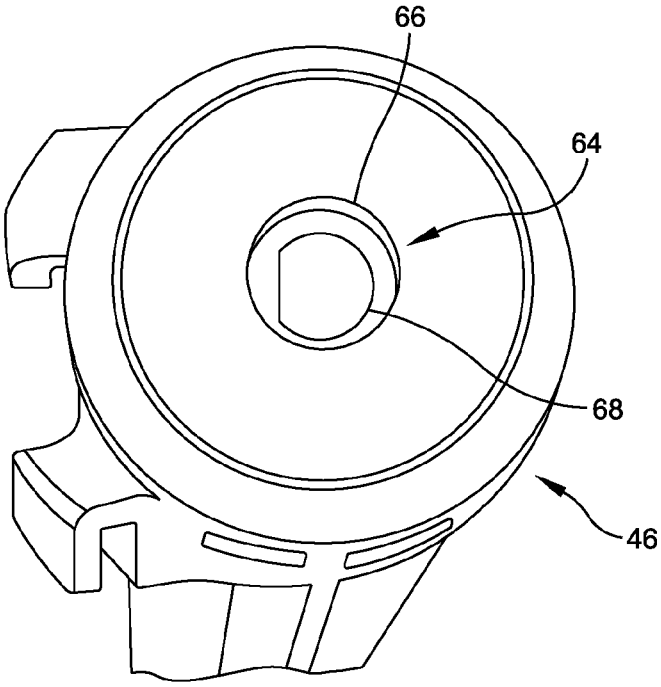
FIG. 9 provides a top perspective view of an accessory mount within the strike pad of FIG. 6.

FIG. 9 illustrates a top perspective view of strike pad 46, discussed above in relation to FIG. 6. In one embodiment, strike pad 46 may include an accessory mount 64. In this embodiment, accessory mount 64 may be formed from a counterbore 66 that enlarges a D-shaped coaxial well 68. To avoid damage to well 68 from hammer strikes during stake installation, counterbore 66 may have a substantial depth dependent upon an associated accessory to be mounted within accessory mount 64 and/or the thickness of strike surface 48 of strike pad 46.

Figure 10:
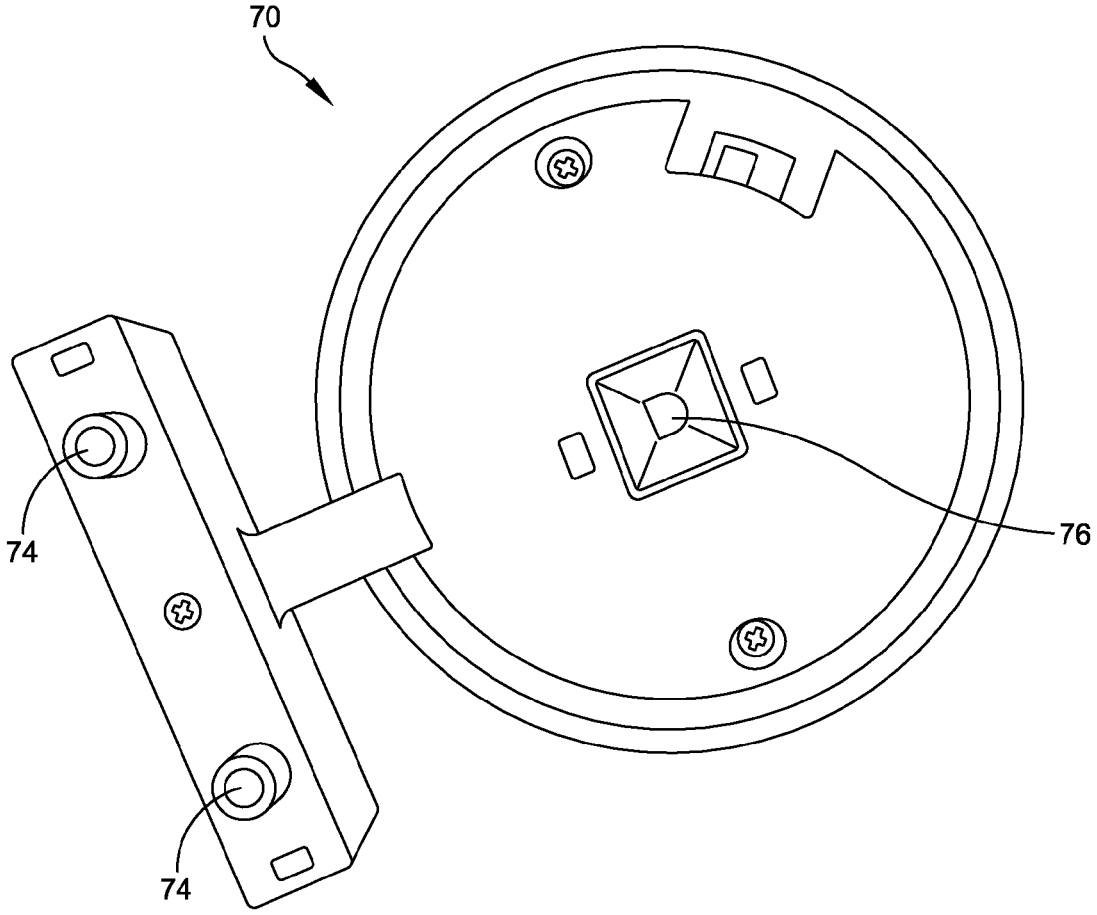
FIG. 10 provides a bottom perspective view of a solar-powered light assembly for mounting upon the signage system of FIG. 3.
Figure 11:
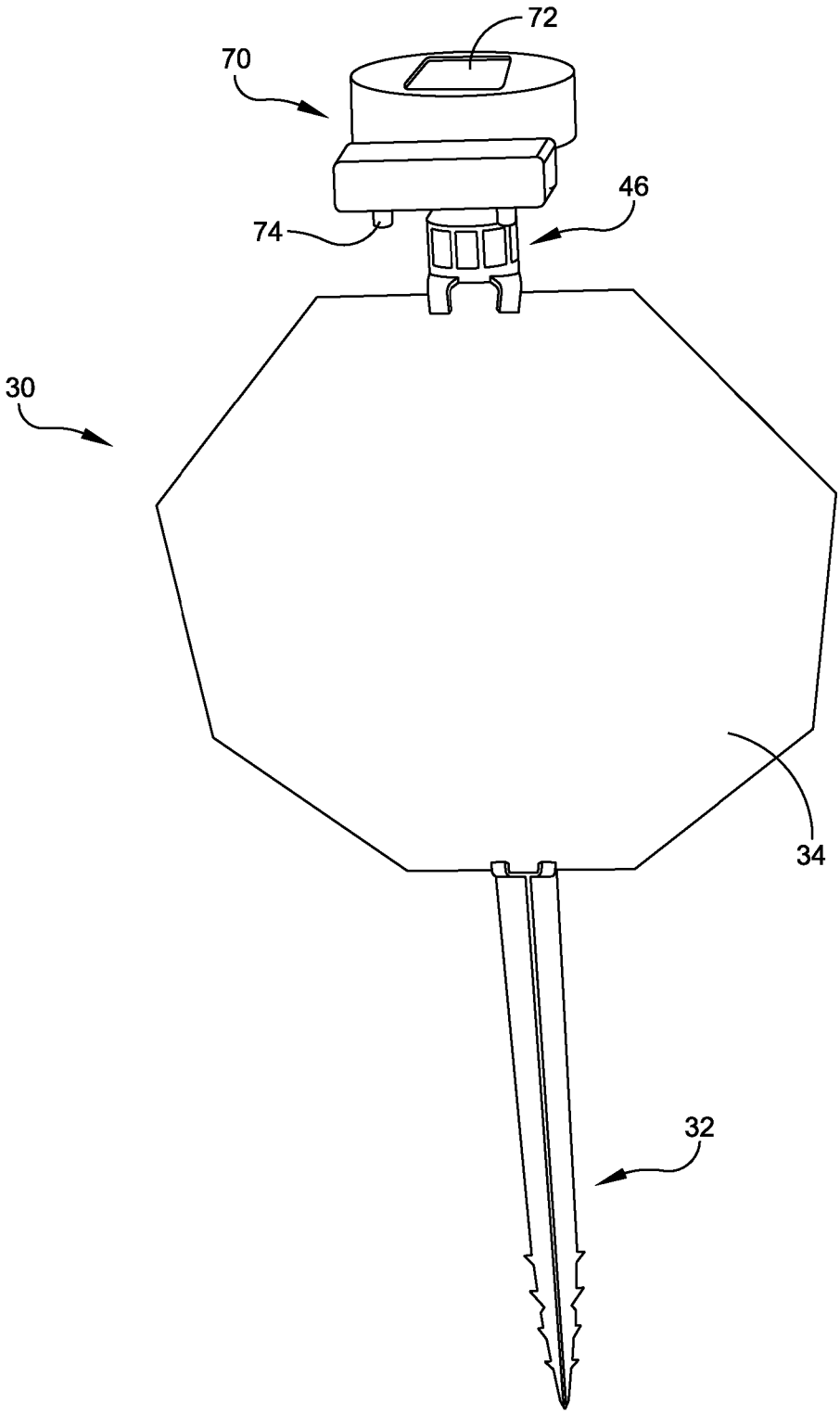
FIG. 11 provides a front perspective view of the solar-powered light assembly of FIG. 10 as mounted upon the signage system of FIG. 3.

FIG. 10 illustrates a top perspective view of an exemplary accessory for mounting within accessory mount 64, and FIG. 11 shows a front perspective view of signage system 30 with the exemplary accessory mounted thereon. In this embodiment, the accessory may be a solar-powered light assembly 70. Solar-powered light assembly 70 may be a custom assembly designed to mount within accessory mount 64 such that it illuminates the area containing sign panel 34, below. In one embodiment, assembly 70 may include a 0.1 Watt solar panel 72 (FIG. 11) that is operatively connected to a 350 mAh NiCad rechargeable battery (not shown), which, in turn, powers two light-emitting diodes (LEDs) 74 that emit at least ten lumens of visible light. Light assembly 70 may also include a center-drafted shaft 76 located at the base of the assembly 70. Shaft 76 may have a D-shaped cross-section that facilitates a secure press-fit between shaft 76 of assembly 70 and D-shaped coaxial well 68 of accessory mount 64, discussed above.

Light assembly 70 provides one example of an accessory adapted for attachment to stake 32. While assembly 70 includes two LEDs on a single side, the assembly could be modified to include additional LEDs on opposing sides to accommodate the dual-sign scenario discussed above. In other embodiments, accessories may take any appropriate form or function. For instance, accessory options may include cameras, holders for business cards and/or promotional materials, audio recorders, audio players, and more.

Figure 12:
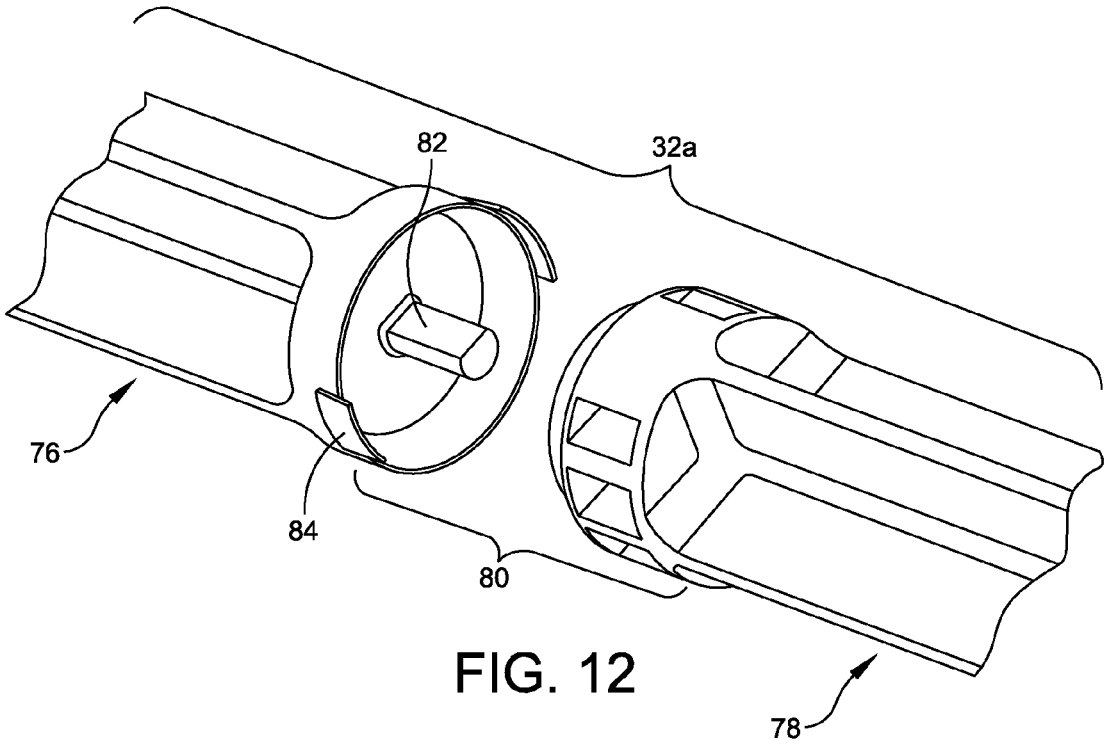
FIG. 12 provides a partial perspective view of another embodiment of a stake for the signage system of FIG. 3 with a snap lock in an unlocked position.
Figure 13:
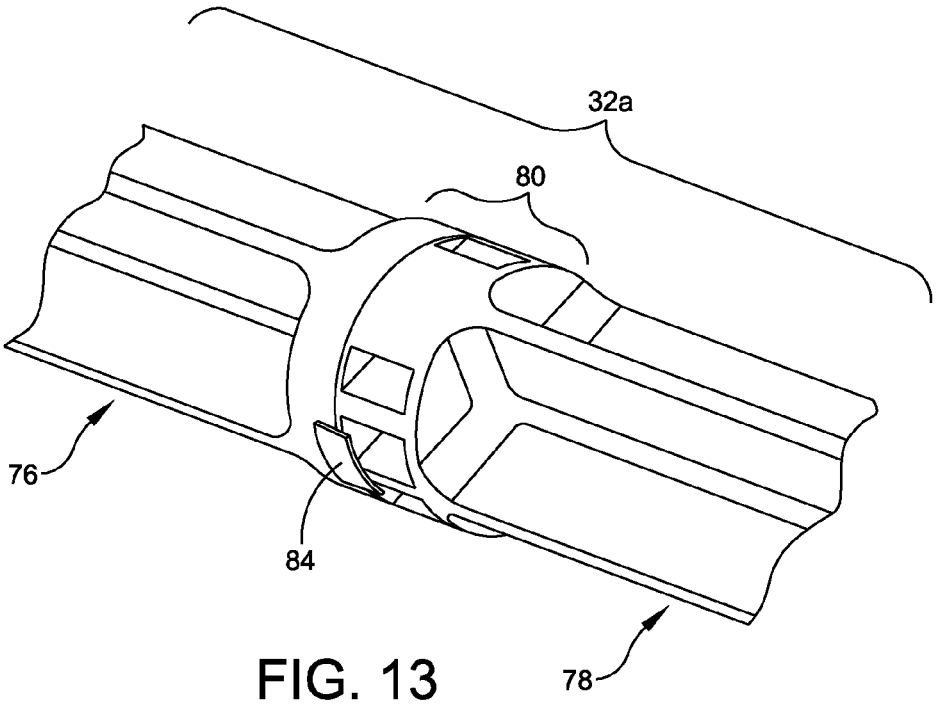
FIG. 13 provides a partial perspective view of the stake of FIG. 12 with the snap lock in a locked position.
Figure 14:
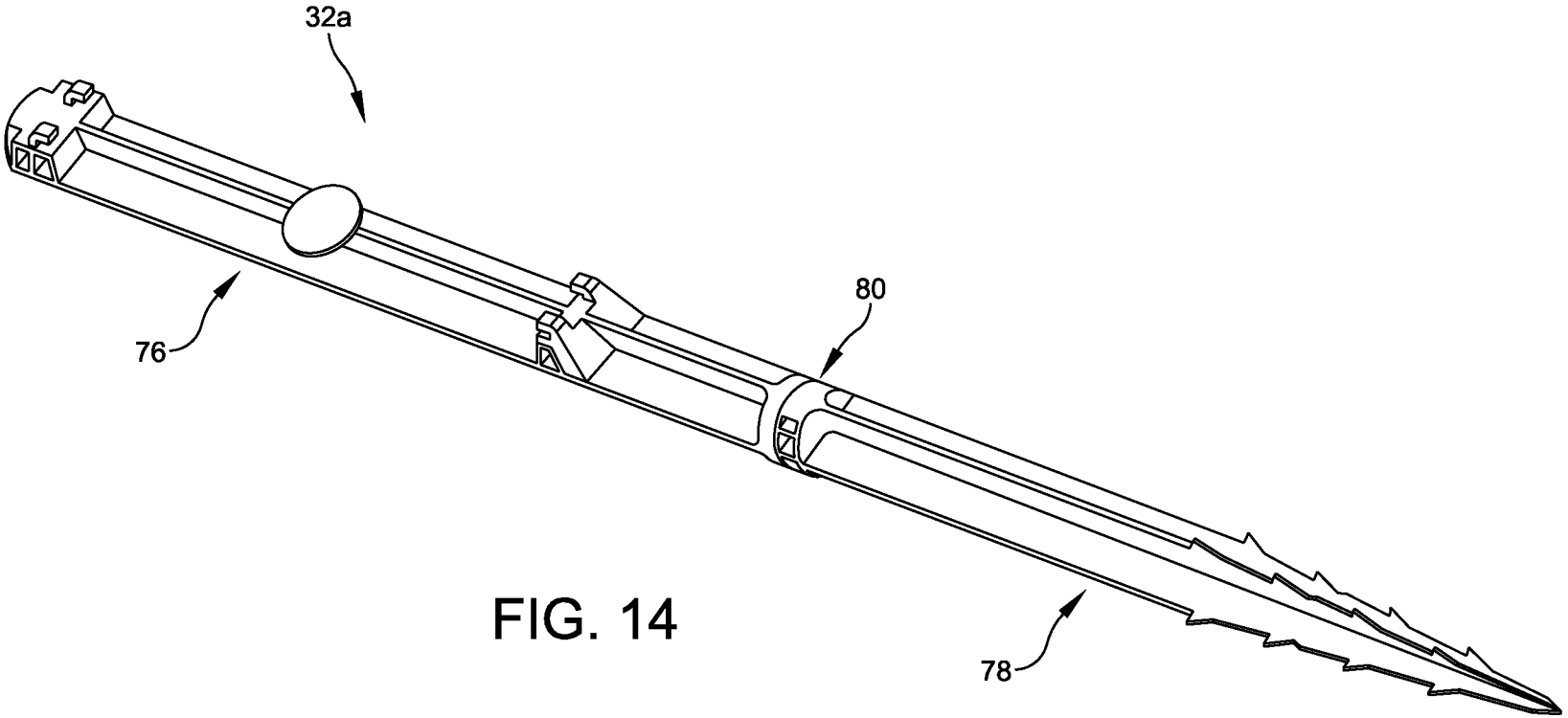
FIG. 14 provides a side perspective view of the stake of FIG. 12.

While stake 32 provides numerous advantages over the prior art, discussed above, it is occasionally advantageous to reduce the length of stake 32 for shipping, packaging, and/or storing purposes. In this regard, an optional embodiment of the rigid stake, stake 32*a*, may feature a two-piece design, as shown in FIGS. 12-14. In this embodiment, stake 32*a* is formed of interlocking top and bottom components 76, 78. Top component 76 and bottom component 78 may be press fit and held together via a mating male-female snap lock 80. Specifically, top component 76 may include a D-shaped male portion 82 adapted to press fit into a corresponding female portion (not shown) within bottom component 78. Snap lock 80 may also include a radial skirt 84 to support axial alignment and provide a locking fit between radial skirt 84 and the corresponding honeycomb portion. When top and bottom stake components 76, 78 are locked into position, they combine to form full-length rigid stake 32*a*, shown in FIG. 14, which is identical to stake 32 with the exception of its two-component structure.

Signage system 30, described above, allows a user to quickly and easily install an attractive, sturdy, resilient, customizable, and affordable lawn or yard sign with minimal hassle. The user may install signage system 30 in a few minutes without the need for several bulky and inconvenient tools. Moreover, the user may replace or update sign panel 34 of signage system 30 in a matter of seconds.

Figure 15:
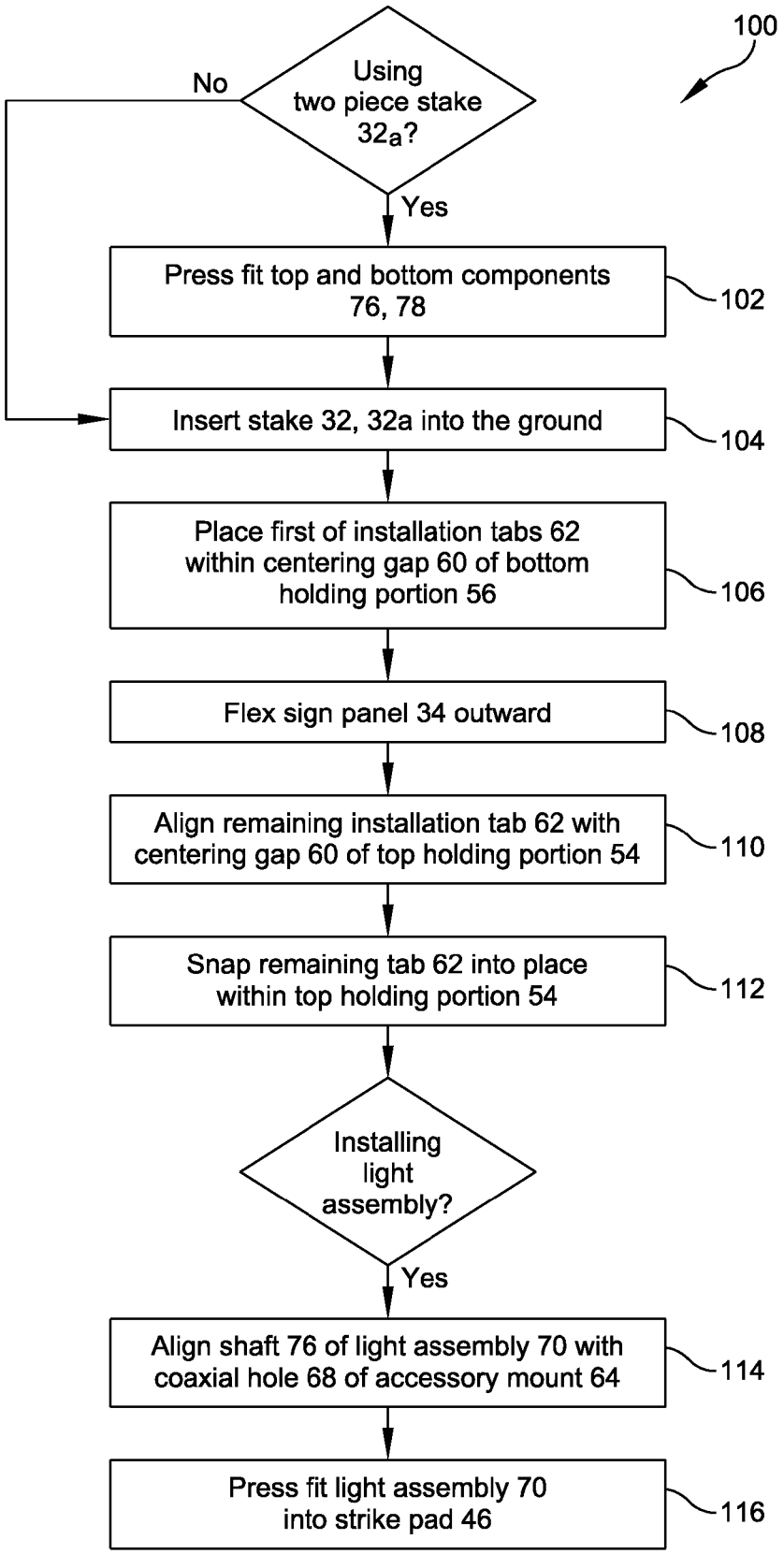
FIG. 15 provides a flow chart illustrating a method for displaying signage using the signage system of FIG. 3.

FIG. 15 provides a flow chart that illustrates a method 100 for displaying signage using signage system 30. If the user is installing two-piece stake 32*a*, the method begins by press-fitting (102) top and bottom components 76, 78 together via snap lock 80 to form full-length stake $\mathbf{32}_a$. Next, the user inserts (104) stake 32, $\mathbf{32}_a$ into the ground. In some instances, stake 32, $\mathbf{32}_a$ may simply be pressed into the ground. In others, the user may drive stake 32, $\mathbf{32}_a$ into the ground by striking strike surface 48 of strike pad 46 with a hammer, mallet, or other driving tool. Once stake 32, $\mathbf{32}_a$ is sturdy within the ground, the user may place one of installation tabs 62 of sign panel 34 within a centering gap 60 of bottom holding portion 56 of stake 32, $\mathbf{32}_a$ (106). Flexing sign panel 34 outward (108), the user may align the remaining installation tab 62 with centering gap 60 of the top holding portion 54 (110) and snap the remaining tab 62 into place within holding portion 54 to securely install sign 34 upon stake 32, $\mathbf{32}_a$ (112).

If the user would like to illuminate sign panel 34, the user may align center-drafted shaft 76 of light assembly 70 with coaxial well 68 of accessory mount 64 (114) and press fit light assembly 70 into strike pad 46 (116). After these simple steps are complete, signage system 30 is fully installed and ready for viewing.

Although the above embodiments have been described in language that is specific to certain structures, elements, compositions, and methodological steps, it is to be understood that the technology defined in the appended claims is not necessarily limited to the specific structures, elements, compositions and/or steps described. Rather, the specific aspects and steps are described as forms of implementing the claimed technology. Since many embodiments of the technology can be practiced without departing from the spirit and scope of the invention, the invention resides in the claims hereinafter appended.

What is claimed is:

1. A two-part system for displaying signage, comprising:

flexible signage having first and second installation tabs; and a rigid stake having top and bottom ends, front and back sides, and a solid core centered within an axially radiating cross-section, said rigid stake including:

first and second holding portions protruding from said front side between said top and bottom ends, said holding portions configured to receive and retain said first and second installation tabs of said flexible signage, respectively;

a plurality of barbs protruding axially from said bottom end; and a strike pad protruding vertically from said top end, said strike pad having a honeycomb structure configured to absorb installation force and distribute the force through said solid core and said axially radiating cross-section.

2. The two-part system of claim 1, wherein said strike pad includes an accessory mount comprising a center counterbore configured to receive a press-fit accessory.

3. The two-part system of claim 2, wherein said accessory is a solar light.

4. The two-part system of claim 1, wherein each of said first and second holding portions includes a centering gap configured to align with each of said first and second installation tabs, respectively.

5. The two-part system of claim 1, wherein said flexible signage comprises first and second sign panels, and wherein said first and second holding portions protrude from said front and back sides of said rigid stake and are configured to receive and retain said first sign panel on said front side of said stake and said second sign panel on said back side of said stake.

6. The two-part system of claim 1, wherein said axially radiating cross-section of said stake forms an x-shape.

7. The two-part system of claim 1, wherein said rigid stake is formed of a top component that interlocks with a bottom component via a built-in snap lock.

8. The two-part system of claim 1, wherein said rigid stake is injection molded from glass-impregnated acetal plastic.

9. The two-part system of claim 1, wherein said flexible signage is formed of UV-resistant polystyrene.

10. The two-part system of claim 1, wherein said rigid stake is black.

11. A method for displaying signage using a signage system having (a) a sign panel with at least two installation tabs and (b) a rigid stake with a top strike pad, a tapered bottom end, and at least two holding portions configured to receive and retain the sign panel, the method comprising:

before inserting said tapered bottom end of said rigid stake into a layer of ground, interlocking a top component including said top strike pad and a bottom component including said tapered bottom end to form said rigid stake;

inserting said tapered bottom end of said rigid stake into the layer of ground;

placing a first of said installation tabs of said sign panel into a first of said holding portions of said rigid stake;

flexing said sign panel outward such that a second of said installation tabs of said sign panel aligns with a second of said holding portions of said rigid stake;

snapping said second installation tab into said second holding portion of said stake to install said sign panel upon said stake; and press fitting an accessory within an accessory mount integrated within said top strike pad.

12. The method of claim 11, wherein said placing said first installation tab occurs after said step of inserting said tapered bottom end.

13. The method of claim 11, wherein said inserting said tapered bottom end comprises hammering said top strike pad into the layer of ground.

14. The method of claim 11, wherein said accessory mount comprises a center counterbore within said strike pad.

15. The method of claim 14, wherein said accessory comprises a solar light.

16. A method for displaying signage using a signage system having (a) a sign panel with at least two installation tabs and (b) a rigid stake with a top strike pad, a tapered bottom end, and at least two holding portions configured to receive and retain the sign panel, the method comprising:

before inserting said tapered bottom end of said rigid stake into a layer of ground, interlocking a top component including said top strike pad and a bottom component including said tapered bottom end to form said rigid stake;

inserting said tapered bottom end of said rigid stake into the layer of ground;

placing a first of said installation tabs of said sign panel into a first of said holding portions of said rigid stake;

flexing said sign panel outward such that a second of said installation tabs of said sign panel aligns with a second of said holding portions of said rigid stake; and snapping said second installation tab into said second holding portion of said stake to install said sign panel upon said stake;

wherein said signage system further comprises a second sign panel, and wherein said holding portions of said rigid stake are configured to receive and retain both said sign panel and said second sign panel, each in an outwardly facing direction from said rigid stake, said method further comprising:

placing a first installation tab of said second sign panel into said first holding portion of said rigid stake;

flexing said second sign panel outward such that a second installation tab of said second sign panel aligns with said second holding portion of said rigid stake; and snapping said second installation tab of said second sign panel into said second holding portion to install said second sign panel upon said stake.

17. A signage system, comprising:

a flexible plastic sign having top and bottom installation tabs located at a center of said sign, said sign configured to move between flat and bowed positions; and a rigid stake molded from acetal plastic, said stake having a top end, a tapered bottom end, and a solid core centered within an axially radiating cross-section, said stake comprising:

top and bottom holding portions disposed between said top end and said tapered bottom end, said top and bottom holding portions configured to receive and retain said top and bottom installation tabs of said sign, respectively;

a disc support integrated into said stake between said top and bottom holding portions, said disc support configured to provide a permanent mounting mechanism for said sign;

a plurality of retention barbs protruding radially from said tapered bottom end;

a strike pad protruding vertically from said top end, said strike pad having a honeycomb structure configured to absorb installation force and distribute the force through said solid core and said axially radiating cross-section, wherein said strike pad includes an integrated accessory mount comprising a counterbore encircling a coaxial D-shaped well; and a solar-powered light assembly having a base configured to interlock with said accessory mount.

18. The signage system of claim 17, wherein said rigid stake comprises top and bottom interlocking components.

* * * * *